United States Patent [19]

Tomaides

[11] 3,985,525

[45] Oct. 12, 1976

[54] ELECTROSTATIC AIR CLEANER

[75] Inventor: Milos Tomaides, Brooklyn Park, Minn.

[73] Assignee: Chemtool, Inc., Minneapolis, Minn.

[22] Filed: July 26, 1974

[21] Appl. No.: 492,251

Related U.S. Application Data

[62] Division of Ser. No. 338,605, March 6, 1973, Pat. No. 3,854,903.

[52] U.S. Cl. ..... 55/138; 55/143; 55/146; 55/147; 55/151

[51] Int. Cl.[2] ..... B03C 3/00

[58] Field of Search ..... 55/124–126, 55/130, 136–139, 140–143, 145–148, 150–157

[56] References Cited

UNITED STATES PATENTS

| | | | |
|---|---|---|---|
| 2,535,696 | 12/1950 | Richardson | 55/143 |
| 2,672,948 | 3/1954 | Penney | 55/141 |
| 2,813,595 | 11/1957 | Fields | 55/137 |
| 3,114,616 | 12/1963 | Palmore | 55/143 |

*Primary Examiner*—Bernard Nozick

*Attorney, Agent, or Firm*—Schroeder, Siegfried, Ryan & Vidas

[57] ABSTRACT

An electronic air cleaning assembly is provided wherein the collector plates are of identical configuration for both the high voltage and gounded plates. The collector plates are provided with a plurality of clearance holes of a generally circular shape and a plurality of spacing holes of a generally rectangular shape. The plates are spaced and supported by tube members having a diameter approximately equal to the width of the rectangular holes. Each tube is provided with a series of spaced slots extending partly therethrough and of a width for engaging one side wall of a rectangular hole in alternate plates thereby spacing and holding the plates in fixed relationship to one another.

A doubled corona charging wire arrangement is also provided wherein a continuous length of wire is used in forming the ionizing section of the electrostatic air cleaner but each cooperative pair of wires is tensioned by an individual tensioning spring.

10 Claims, 10 Drawing Figures

ELECTROSTATIC AIR CLEANER

This is a division of application Ser. No. 338,605, filed Mar. 6, 1973 now U.S. Pat. No. 3,854,903 issued Dec. 12, 1974.

The present invention is directed to an improved electrostatic air cleaner designed so as to be readily assembled and composed of parts which minimize the number of individually different parts that must be utilized in the production thereof. The invention also provides an ionizing section for an electrostatic air cleaner wherein a double ionizing wire arrangement is utilized to increase the efficiency of electrical charging of the particles in the air passing therethrough at voltages reduced below that ordinarily required in such an ionizing section.

In still another aspect of the present invention a shielding means is provided for the insulators which are utilized in mounting and supporting the high voltage collector plates so as to minimize the tendency for deposit of charge particles on the surface of the insulator. Such a buildup of charges particles on the insulator surface is undesirable as it increases the probability of arc-over between the high voltage plate assembly and the grounded plate in which the insulators are mounted.

IN THE DRAWINGS

Figure 4A:
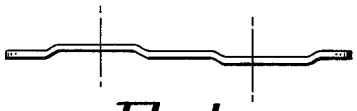
FIG. 4 is a side elevational view of a collector plate in accordance with the invention.
Figure 4:
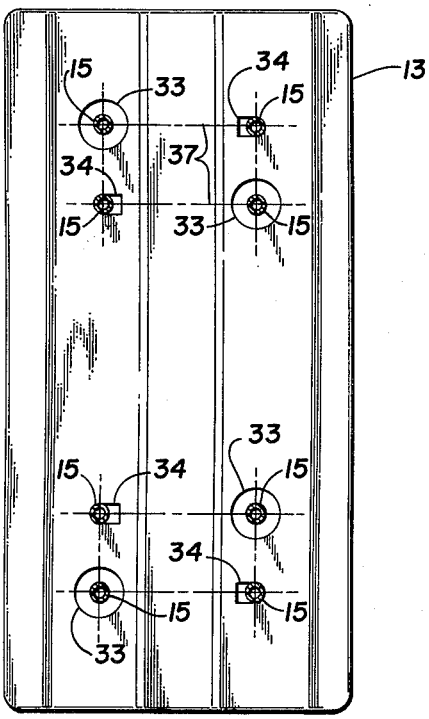
Figure 7:
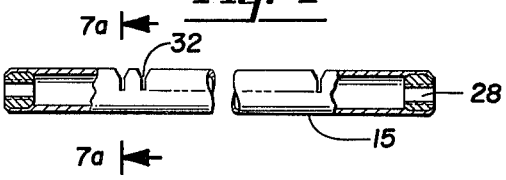
Figure 7A:
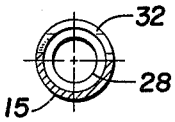
Figure 3:
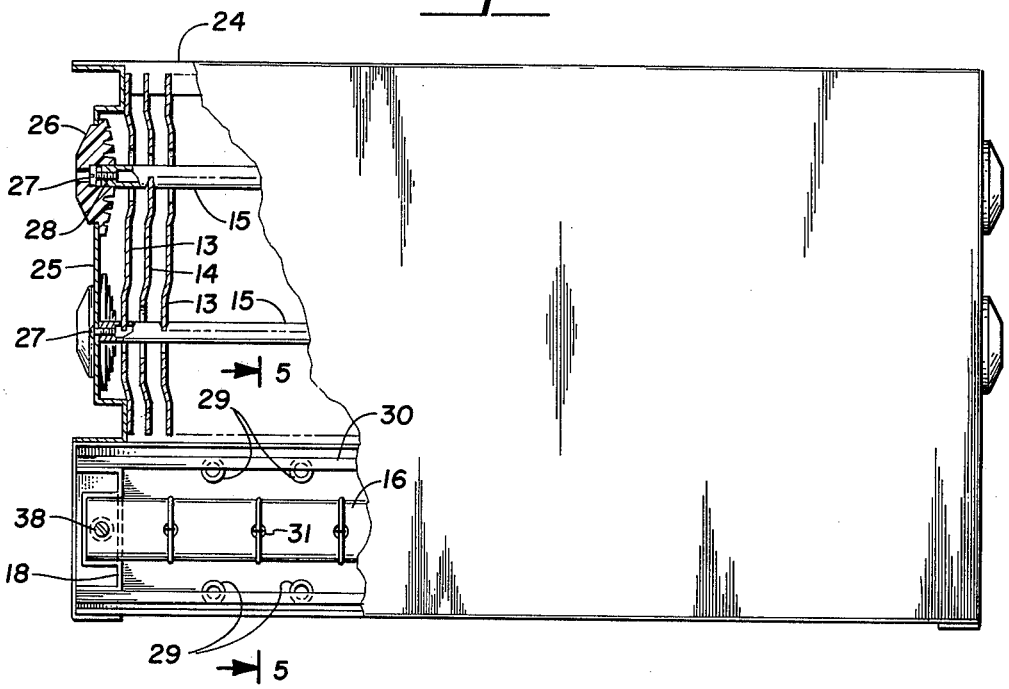
FIG. 3 is a top elevational view partially in section of an electronic air cleaner in accordacne with the invention.
Figure 5:
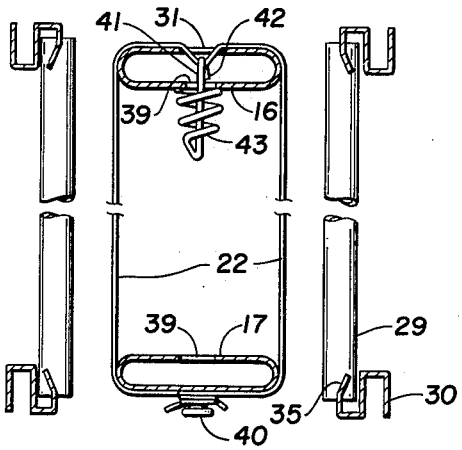
Figure 6:
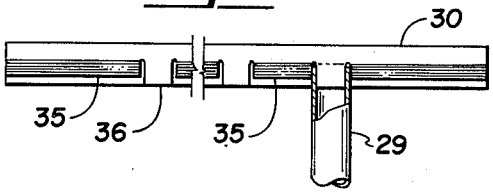

FIG. 4*a* is an end view of the plate of FIG. 4;

FIG. 5 is a cross-sectional view of the ionization portion of the air cleaner along lines 5—5 of FIG. 3;

FIG. 6 is a side elevational view of a grounded ionization electrode holder beam;

FIG. 7 is a cross-sectional view of a collector plate separator;

FIG. 7*a* is a sectional view along lines a—a of FIG. 7; and

Figure 8:
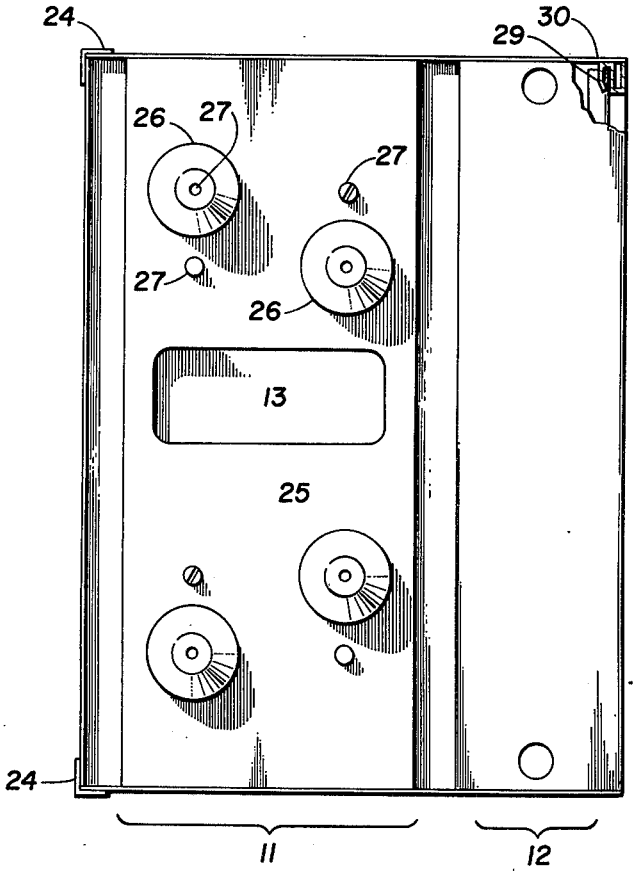

FIG. 8 is a side elevational view of a side panel of the electrostatic air cleaner of the invention.

Figure 1:
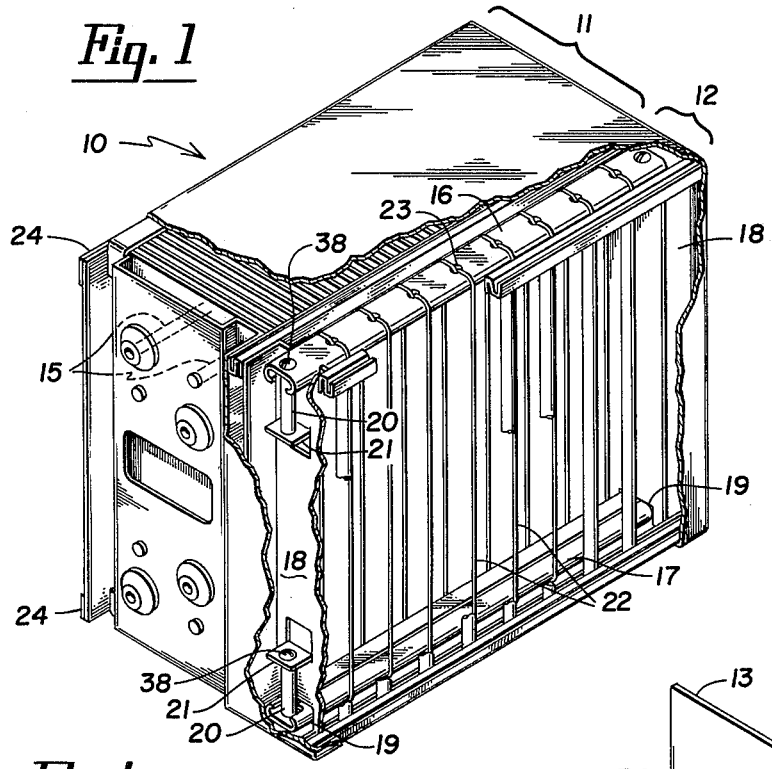
FIG. 1 is a perspective view with the outer shell removed of an air cleaner in accordance with the invention.

Referring now to the drawings where the same numerals will be used to identify like parts in the several views, there is illustrated in perspective view in FIG. 1 an electrostatic air cleaner in accordance with the invention. For the sake of clarity the side panel portions have been removed as have the grounded ionization tubes for the ionization section. The air cleaner is generally designated 10 and consists of an ionization section 12 and a collector region 11. Such a unit is ordinarily inserted into suitable ductwork with means to create an airflow therethrough in the direction indicated by the arrow. That is, the air to be cleaned passes first through ionization section 12 and the ionized gas containing electrically charges particles is then passed through collecting region 11.

The collector region of the apparatus in accordance with the invention consists of a plurality of uniformly spaced collection plates 13 and 14 which are parallel to one another with alternate plates being of opposite charge. The supporting means for the plates 13 and 14 are rod or tube members 15 which pass through openings in the plates as will be described in greater detail herein below. Plates identified 14 will be considered to be the high voltage plates while plates 13 will be the grounded collector plates. The tubes 15 are so positioned through the plates that any given tube 15 contacts only grounded plates or alternatively contacts only high voltage plates. The tubes 15 which support plates 13 and 14 in electrical isolation and in appropriate spacing therebetween are mounted to a side wall 25 as illustrated in FIGS. 3 and 8.

While the apparatus in accordance with the invention can be formed of a wide variety of metals, it is most conveniently and economically formed of aluminum metal. Except where otherwise indicated the elements forming the apparatus of the invention are of formed aluminum.

Turning now to FIG. 4 and FIG. 4*a* there is illustrated in front elevational view and in side elevational view respectively a collector plate member 13. The plate members 14 are of identical construction to plate members 13. With the exception of the charge that is applied to the plates in actual operation they are equivalent and the description which follows is applicable to each.

Figure 2:
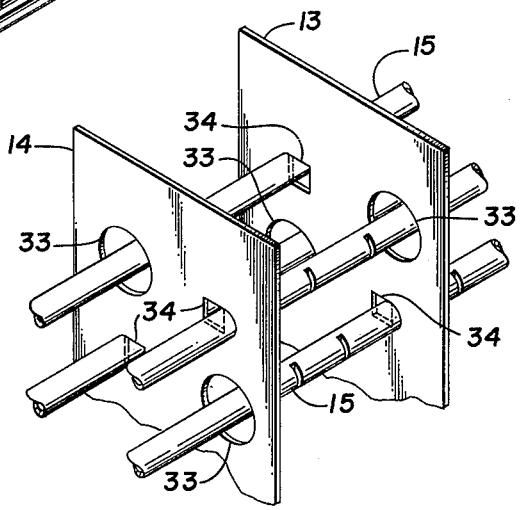
FIG. 2 is a perspective view of portions of two plates of the collector region showing the spacer and support rods of the invention extending through the plates.

As can be seen in FIG. 4 the plate member consists of a generally rectangularly shaped piece of aluminum metal which has been provided with a series of offset bends as best seen in FIG. 4 so as to increase the overall rigidity of the plate. Note that the offset bends are of a nature such that the plate is symmetrical about its longitudinal axis. Such ridigity is highly desirable for holding plates parallel and to reduce the amount of flutter that tends to occur during the passage of air between the collector plates when in service. In the showing of FIG. 2 this complex shaping of the plates to lend rigidity thereto has been omitted for sake of clarity in the drawings. While such shaping is not critical it does contribute in a significant way to the overall advantages of the invention.

The plates 13 are provided with a plurality of circular and rectangular openings therethrough arranged as indicated in FIG. 4. It is of importance that the openings and the attendant support structure be as illustrated to equally space the plates on the assembly and to lend further rigidity to the plates which otherwise have a tendency to flutter during flow of air therethrough. Each end of the plate 13 is provided with two circular openings and two rectangular openings at the diagonally opposite edges of a rectangular alignment. The circular openings are designated 33 and the rectangular openings 34. Center lines for positioning of rod members 15 for mounting of the plates are designated 37. It will be seen that holes 33 are centered along the intersections of lines 37 whereas rectangular holes 34 are offset from the intersection of centering lines 37. The reason for this arrangement will now be described.

Turning to FIGS. 7 and 7*a* there is shown in cross-sectional view a tube 15 in accordance with the invention. Tube 15 may be a solid rod with the exception of the end portions utilized in aligning although for reasons of weight and economy it is desirable to use a hollow tube. The tube member 15 is provided with a plurality of slots 32 at spaced intervals along the length thereof. Slots 32 extend approximately one-third of the way across the diameter of the tube. At each end of tube 15 there is provided a sleeve member 28 which has been pressed or otherwise formed into the end of a tube for use in aligning the tubes and holding the collector assembly together. The slot 32 is desirably wider at the outer edge thereof than at its innermost termination point. The chord of the slot at its broadest point corresponds substantially to the width of the side wall of opening 33 in plate 15.

Referring again to FIG. 4, it will be seen that the arrangement of circular and rectangular openings differs from one end of plate 13 to the arrangement at the opposite end thereof. That is, the diagonally opposite arrangement of rectangular and circular holes is such that one can by rotating alternate the plates so as to provide a sequence of circular and square openings by merely inverting alternate plates. This is best seen in the partially showing of FIG. 2 wherein plates 14 and 13 are of the shape and hole configuration shown in FIG. 4 with the ends reversed so that a square hole corresponds generally in alignment with a circular hole.

It should now be apparent that by passing tubes 15 through a collection of plates arranged in alternate form as illustrated in FIG. 2 that tube 15 will pass midway through the center of opening 33 in one plate and will contact the side walls of opening 34 in the next adjacent plate. The purpose of slot 32 is to pass over one side wall of opening 34 and thereby fixing the inter-plate spacing between plates of the same polarity. By providing the slots at the desired spacing between similarly charged plates, tubes 15 provide the dual purpose of insuring the correct spacing between plates and also of supporting the plates against movement in direction to the plane of face thereof or in any other direction. It will also be apparent that by use of a simple cylindrical tube without projections locking inserts or the like that advantages are realized over prior art arrangement. Cost and fabrication problems are greatly reduced. Also as the tube is free of projections arc-over tendency is likewise negligible. The circular to circular configuration of the mounting hole and spacing rods reduce the tendency for arcing.

Side wall member 25 as illustrated in FIGS. 3 and 8 is provided with a plurality of large circular openings into which an insulator disc 26 of a material such as steatite is positioned. Insulator 26 has an opening through the center thereof into which is inserted a tube 15 that is in electrical connection with and supports the high voltage plates 14. An alignment screw 27 cooperates with insert 28 and is utilized to adjust the inter-plate spacing between grounded plates 13 and high voltage plates 14.

Grounded plates 13 are joined to a similar tube 15'. The slots 32 are appropriately spaced from one another and from the ends of tube 15'. The grounded plates 13 are fixedly joined to end plate 25 by means of screw 27. Thus, tube 15 not only spaces and holds grounded plates 13 but likewise holds the entire assembly of the end walls 25 and plates 13 in fixed relationships to one another.

Insulator disc 26 is provided with convolutions along the interior face thereof to aid in insuring insulation of the grounded plate 25 from the high voltage of the plates 14 and their supporting tubes 15. In the instance of the high voltage assembly the screws 27 can be used to adjust tubes 15' and the high voltage plates 14 with respect to grounded plates 13 to provide uniform spacing therebetween.

It should be noted as illustrated in FIG. 3 that a ground plate 13 adjacent each of the side walls 25 is in direct contact therewith and provides a shielding of the insulator 26 from the air stream flowing between the balance of the plates 13 and 14. Thus, charged particles which might be deposited on the insulators 26 are to a large degree restricted from access to the chamber defined between outermost plate 13 and the outer wall member 25. This shielding arrangement markedly decreases the amount of dirt and the like that accumulates on the inner facing surface of insulator 26.

Wall members 25 are held in spaced relationship from one another both by means of tubes 15, by means of side wall supports 24 adjacent the down wind side of the collector region 11 and by means of ionization channel support members 30 in the ionization region 12. Wall members 25 can be joined to these supports 24 and 30 by any appropriate means such as welding or rivoting.

It should be apparent that there is no need for individual fastening of the collector plates to tubes 15. The slots 32 restrict the movement of the plates along the length of tubes 15 and as the slots are in oppositely oriented direction engaging the sides of rectangular openings 33 any movement of the plates perpendicular to the tubes 15 is likewise restrained.

As already noted, the grounded collector plates 13 are in electrical contact with the chassis of the assembly. The high voltage plates are all in electrical contact with one another by means of tubes 15 so a single connection of a high voltage source to any one of the plates or to any one of the tubes supporting the high voltage plates will impress the same potential to each of the high voltage plates.

The ionization region 12 of the electrostatic air cleaner in accordance with the invention will now be described. The ionization section consists of ionizing wires 22 which are maintained during operation at a high voltage and a plurality of grounded ionization tubes 29 which are placed adjacent to wires 22 both upstream and downstream of the wires. The assembly comprising the ionization section is constructed in the following manner. Channel shaped end support members 18 are provided with L shaped angle members 21 as seen in FIG. 1. The support member 18 is provided with openings 19 at each end thereof on the interior facing sides thereof through which extend upper ionization wire supports 16 and lower wire support 17. Angles 21 are the support means for an insulator 20 which in turn supports members 16 and 17 in electrical isolation from the balance of the assembly. Insulators 20 may be joined by suitable means such as threaded screws 38 both to angles 21 and to the wire support members 16 and 17. An air space is provided between arms 16 and 17 and the sides of member 18.

Wire supports 16 and 17 are best seen in cross-sectional view in FIG. 5 as being formed of a substantially closed rectangular tube which has a slot 39 extending along the length thereof on the side interior thereof. On the exterior side of support 16 there is provided a plurality of holes 31 at spaced intervals.

Support member 17 is of similar construction to 16 but has on the outward side thereof a plurality of studs 40 at spaced intervals there along corresponding in position to the openings 31.

Ionizing wires 22 are desirably formed of a single length of wire. The wire 22 is first wrapped about the end stud 40 at either end of the assembly and is then passed around the outer sdie of member 17 up and around member 16 passing directly across one of the holes 31 and then downwardly back around member 17 to re-engage the same stud 40. The wire is then passed along the underside of member 17 to engage a second stud member and the procedure is repeated until the entire ionizing wire section has been constructed. In order to maintain the desired tensioning of wires 22 an integral spring and hook member 41 is utilized as best seen in FIG. 5. After winding of wire 22 into the approximate tension desired member 41 is positioned so that the hook end thereof extends through slot 39 and up through hole 31 where the curved hook 42 passes over the wire. The spring portion 43 then draws the hook 42 downwardly to place wire 22 in the desired tension. It is thus apparent that each set of wires 22 while being formed of an overall single length of wire acts essentially independently of each adjacent set of ionization wires insofar as its own individual tension is concerned. Thus, if a wire should break in service, it may be readily removed, a new wire wound about stud 40 and around the members 16 and 17 and retensioned by means of spring and hook assembly 41.

The grounded ionization tubes 29 are held in spaced relationship with respect to ionization wires 22 by means of an S shaped channel member 30 at each end thereof. S shaped channel member 30 is joined by means of welding or rivets to end wall members 25. The S shaped channel member 30 has a plurality of tab members 35 bent inwardly to leave straight sections 36 which engage the ends of tubes 29 holding them in spaced relationship to one another. As channel support arm 30 is in electrical contact with grounded wall 25 tubes 29 will likewise be electrically grounded.

The overall ionization assembly thus is seen to consist of a double array of wires 22 and a double array of grounded ionization tubes 29. This doubling arrangement or two stage system provides for maximum charging efficiency and makes possible lower voltages in the ionization section of the electrostatic air cleaner than is possible in conventional systems thus decreasing the amount of ozone generated. As air is swept into the overall electronic air cleaning arrangement it passes first through the outermost series of grounded ionization tubes 29 then past a first set of high voltage charging wires 22, then past the second set of high voltage charging wires and then past the second set of grounded ionization tubes 29. The now electrically charged particles and ionized air pass through the collector section where the charged particles are attracted to the appropriate collector.

What is claimed is:

1. An electronic air cleaning collector cell assembly consisting of alternate parallel collecting plates providing interleaved groups of different polarity, a plurality of aligned mounting holes and clearance holes in each group of collecting plates, spacing rods, said spacing rods having slots extending transversely partially therethrough at spaced intervals along the length thereof, said spacer rods extending through said mounting holes and being displaced with respect thereto to insert a portion of said plates of the same polarity into said slots to provide inter-plate spacing with said rod passing through said clearance holes in the interleaved plates of opposite polarity, side wall members, said side wall members having holes therethrough matching the location of said rods, means cooperating with said spacing rods and said holes in said side walls to abut and secure the inside faces of said side wall against the ends of the spacer rods in contact with plates of one polarity and insulating means on said side panels to insulate said spacer rods in contact with plates of the opposite polarity from said side panels.

2. An assembly in accordance with claim 1 wherein said side wall members are in physical contact with the ends of the plate members adjacent thereto and define therewith an intervening chamber, said chamber providing shielding of said insulating means from the flow of air passing through said collector cell assembly.

3. An assembly in accordance with claim 1 wherein said collecting plates are of an identical configuration for both polarities and said clearance holes and said mounting holes are positioned and arranged on said plates so that by rotation of said plates about a center axis thereof alternate mounting holes and clearance holes are indexed in consecutive plates.

4. An assembly in accordance with claim 1 wherein at least one of said spacer rods is displaced relative the mounting hole through which it extends in a direction of displacement opposite to another spacing rod in the same polarity plate so that said plate is held against movement in the plane of said plate.

5. An assembly in accordance with claim 1 wherein all of said plates have a plurality of offset bends arranged symmetrically about the longitudinal axis thereof so as to lend rigidity thereto.

6. An assembly in accordance with claim 1 wherein said mounting holes have at least one side thereof which is a straight line.

7. An assembly in accordance with claim 6 wherein said mounting holes are rectangular in shape.

8. An assembly in accordance with claim 7 wherein said spacing rod has a circular cross section.

9. An assembly in accordance with claim 8 wherein said clearance holes are circular and said rods pass through the center thereof.

10. An electronic air cleaner assembly comprising spaced formed sheet members defining an airflow conduit, an ionizer region mounted within the upstream portion of said conduit, said ionizer region including first and second spaced channel shaped members insulatively supported by wall portions of said conduit, the first of said channel members defining a plurality of spaced openings in the outer surface thereof and extending along the length thereof, the second of said channel members having a plurality of spaced wire mounting means along the length thereof corresponding in position to said openings, ionization wire joined at each of said wire mounting means and extending around the outermost edges of each of said channels and across said openings thereby defining a plurality of spaced ionizer wire couples, grounded ionizer tubes forming an array of tubes upstream and downstream of said wires and generally parallel to the longitudinal axis of said wires, said tubes being positioned along lines intermediate adjacent ionizer wire couples, a collector region downstream of said ionizer region, said collector region consisting of alternate parallel collecting plates providing interleaved groups of different polarity, a plurality of aligned mounting holes in each group of collecting plates, spacing tubes, said spacing tubes having slots extending transversely partially therethrough at spaced intervals along the length thereof, said spacer tubes extending through said mounting holes and being displaced with respect thereto to insert a portion of said plates of the same polarity into said slots to provide inter-plate spacing with said tube passing through said clearance holes in the interleaved plates of opposite polarity, opposite side walls of said conduit defining a plurality of openings therethrough matching the location of said tubes, means cooperating with said spacing tubes and said openings in said side walls to abut and secure the inside faces of said side walls against the ends of the spacer tubes in contact with the plates of one polarity and insulating means on said side walls to insulate said spacer tubes in contact with plates of the opposite polarity from said side walls.

* * * * *